US005734951A

United States Patent [19]

Maekawa et al.

[11] Patent Number: 5,734,951

[45] Date of Patent: Mar. 31, 1998

[54] IMAGE FORMING APPARATUS

[75] Inventors: Kazunobu Maekawa; Futoshi Hamada, both of Toyokawa, Japan

[73] Assignee: Minolta Co., Ltd., Osaka, Japan

[21] Appl. No.: 748,036

[22] Filed: Nov. 12, 1996

[30] Foreign Application Priority Data

Nov. 13, 1995 [JP] Japan ..... 7-319696

[51] Int. Cl.[6] ..... G03G 15/02; G03G 21/06

[52] U.S. Cl. ..... 399/169; 399/50; 399/128; 399/303

[58] Field of Search ..... 399/343, 350, 399/50, 169, 170, 171, 128, 303

[56] References Cited

U.S. PATENT DOCUMENTS 4,432,631 2/1984 Bacon et al. ..... 399/148

5,182,603 1/1993 Yamada .

5,493,381 2/1996 Lange et al. ..... 399/344

*Primary Examiner*—R. L. Moses

*Attorney, Agent, or Firm*—McDermott, Will & Emery

[57] ABSTRACT

An image forming apparatus in which a toner image formed on an image carrier is transferred onto paper held onto a transfer drum following which the paper is separated from the transfer drum, the image forming apparatus being equipped with a charger that charges a prescribed area of the image carrier before the image carrier is uniformly charged, a mode setting device that sets the image formation mode, and a control device that controls the output of the charger in accordance with the image formation mode set by the mode setting device.

8 Claims, 14 Drawing Sheets

IMAGE FORMING APPARATUS

BACKGROUND OF THE INVENTION

1. Field of the Invention

The present invention pertains to an image forming apparatus using the electrophotographic method or the static recording method, and more particularly, to a multi-color image forming device equipped with more than one developer.

2. Description of the Related Art

Apparatuses that form toner images on a photosensitive drum and transfer the images in an overlapping fashion onto paper held onto the transfer drum (U.S. Pat. No. 5,182,603, for example) have been conventionally proposed. In an apparatus of this type, the surface of the photosensitive drum is generally negatively charged and its potential is reduced via exposure to a laser beam in accordance with the image. Subsequently, toner that is negatively charged for the purpose of reversal development adheres to the photosensitive drum. When a transfer electric field set to be positive is applied to the photosensitive drum, the toner image formed on said drum is transferred onto paper that is held onto the transfer drum. After one transfer session, the paper is not separated but continues to be held onto the transfer drum and brought to the transfer position once again in order to transfer the toner image for the next color image. After this process is performed for each of the colors of yellow, magenta, cyan and black, the paper is separated from the transfer drum and the toner images transferred onto the paper are then fused onto the paper.

However, in the apparatus described above, if polyvinyliden fluoride resin film is used as the paper carrier sheet for the transfer drum, the positive charge from the transfer charger is injected into the paper through the paper carrier sheet, and the positive charge is accumulated at the surface area of the last edge of the paper. The positive charge thus accumulated forms a strong electric field between the paper and the photosensitive drum surface, and when the last edge of the paper separates from the photosensitive drum, electrical discharge occurs. The negative charge in the air is then attracted to the positive charge of the paper and moves to the paper. Positive charge in the air, however, moves to the photosensitive drum which is negatively charged, and causes damage, i.e., a memory effect, to the photosensitive drum. This memory effect reduces the amount of charge accumulated on the photosensitive drum via the charger, making uniform charging of the photosensitive drum impossible. This in turn causes unevenness in image. Specifically, as shown in FIGS. 11*a* through 11*e*, the surface of the photosensitive drum is uniformly charged with −600V. After this, the image area is irradiated by a laser beam such that the charge level will be −200V, and the image is developed using the developer. Then, as shown in FIG. 11*b*, the charge level of the photosensitive drum other than the image area becomes −300V by irradiating said entire drum by means of a pre-transfer eraser. As shown in FIG. 11*c*, a positive charge is accumulated in the photosensitive drum due to the electrical discharge that occurs as the paper separates after transfer, and a +200V memory area is created. Even when the entire photosensitive drum is irradiated by the eraser as shown in FIG. 11*d*, this +200V memory area remains. As shown in FIG. 11*e*, the photosensitive drum receives a uniform charge of −600V from the charger, but the memory area does not become sufficiently charged, and its charge level becomes −400V. This creates image unevenness in the subsequent developing session. While it is possible to charge this memory area only before the entire photosensitive drum is uniformly charged by the charger in order to eliminate the memory area, since the level to which the memory area should be charged is not considered, an unnecessarily strong charge is often applied, which damages the photosensitive drum. When the charge is reduced in order to prevent this problem, it is often made too weak, which negatively affects the images.

SUMMARY OF THE INVENTION

The object of the present invention is to provide an image forming apparatus that can, by eliminating the memory area created on the photosensitive drum, prevent the occurrence of image unevenness caused by electrical discharge that takes place when the paper separates, without unnecessarily damaging the photosensitive drum.

The object of the present invention is attained by means of an image forming apparatus in which the toner image formed on the image carrier is transferred onto paper held onto the transfer drum following which the paper is separated from the transfer drum, said image forming apparatus being equipped with a charger that charges a prescribed area of the image carrier before the image carrier is uniformly charged, a mode setting means that sets the image formation mode, and a control means that controls the output of said charger in accordance with the image formation mode set by said mode setting means.

Further, in order to attain the object described above, said mode setting means preferably sets the paper size, or the number of sheets to be held onto the transfer drum.

Said control means changes the output of the charger among several level options.

The object of the present invention is also attained by an image forming apparatus in which the toner image formed on the image carrier is transferred onto paper held onto the transfer drum following which the paper is separated from the transfer drum, said image forming apparatus being equipped with a pre-transfer eraser to eliminate the charge of the non-developed areas of the image carrier prior to the transfer of the toner image onto the paper held onto the transfer drum, as well as a control means that controls the output of the pre-transfer eraser for a prescribed area of the image carrier such that it is different from the output of the pre-transfer eraser for areas other than the prescribed area.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The embodiments of the present invention are explained below with reference to the drawings.

Figure 1:
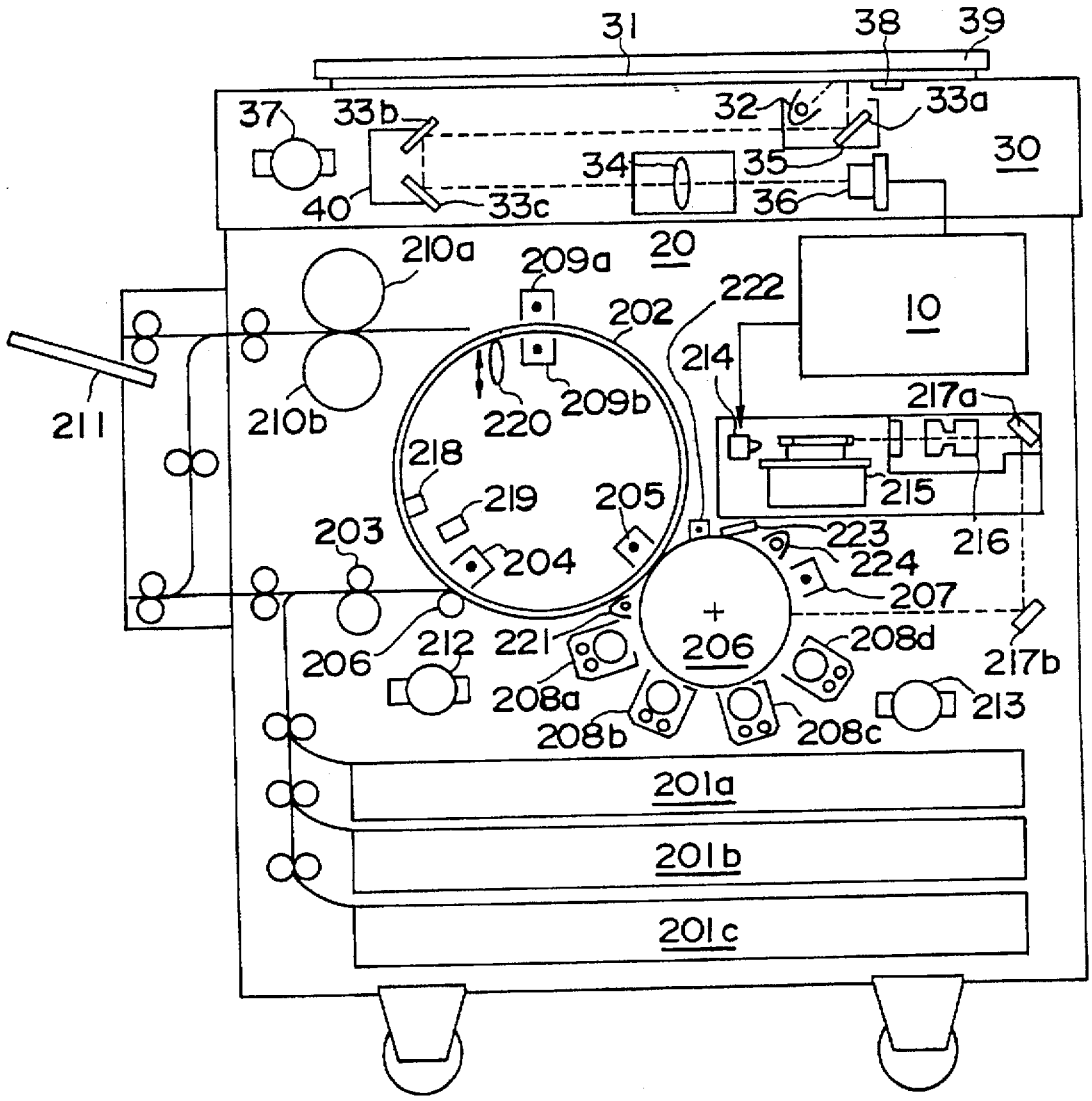
FIG. 1 is a center cross-section of an image forming apparatus in which the present invention is applied.

FIG. 1 shows the entire construction of a digital full-color copier.

The digital full-color copier reads the original using image scanner 30 and performs signal processing using digital signal processing unit 10. Printer 20 prints out an image corresponding to the original image read by image scanner 30 onto a sheet of paper using multiple colors.

In image scanner 30, the original placed on platen glass 31 is held by platen cover 39, but when an automatic feeder (not shown in the drawing) is used, said automatic feeder replaces platen cover 39. The original on platen glass 31 is irradiated by lamp 32. The light reflected by the original is led by mirrors 33*a*, 33*b* and 33*c*, and forms an image on linear full-color sensor (CCD) 36 via lens 34. It is then converted into full-color information comprising red (R), green(G) and blue (B) components, and sent to signal processing unit 10. Through the driving of scanner motor 37, first slider 35 and second slider 40 move mechanically at speeds V and speed V/2, respectively, perpendicular to the direction of electric scanning by linear full-color sensor 36, scanning the entire original. White plate 38 used for shading correction is placed at one end of platen glass 31. Signal processing unit 10 electrically processes the signals read, whereby they are broken down into magenta (M), cyan (C), yellow (Y) and black (Bk) components and sent to printer 20. Each time the original is scanned in image scanner 30, one of the components, i.e., C, M, Y or Bk, is sequentially sent to printer 20. One printout session is completed with four scannings of the original (Sequential image transfer method).

The C, M, Y and Bk image signals from signal processing unit 10 drive and modulate semi-conductor laser 214 in accordance with the image signal level using a laser diode drive (PHC). The laser beam scans photosensitive drum 206 via polygonal mirror 215, f-θ lens 216 and reflecting mirrors 217*a* and 217*b*.

The developer unit comprises C, M, Y and Bk developers 208*a*, 208*b*, 208*c* and 208*d*. Developers 208*a*, 208*b*, 208*c* and 208*d* each develop the electrostatic latent image formed on photosensitive drum 206 using toner. On the other hand, paper fed from paper feed unit 201*a*, 201*b* or 201*c* is wound around transfer drum 202 by means of paper holding charger 204 and conveyed to the transfer position by timing roller 203. The image developed on photosensitive drum 206 is transferred onto the paper by means of transfer charger 205. Paper holding charger 212 is made to come into contact with and separate from transfer drum 202 based on the turning ON and OFF of solenoid SL4. After the four colors, i.e., C, M, Y and Bk, are sequentially transferred onto the paper in this way, the paper is separated by means of separation chargers 209*a* and 209*b* and push-up member 220. It is then conveyed to pass through fusing rollers 210*a* and 210*b* and ejected onto paper exit tray 211. 218 and 219 are transfer drum reference position sensors. The paper is held onto transfer drum 202 such that the first edges of the sheets are placed at these positions. When image transfer onto the paper on transfer drum 202 is completed by means of transfer charger 205, photosensitive drum 206 is negatively charged by pre-cleaner charger 222. The residual toner is eliminated by cleaner 223, and the residual charge is removed by eraser 224. Photosensitive drum 206 is then charged again by charger 207, a latent image is formed by means of the laser beam, development is carried out by developer unit 208, and the charge existing in non-developed areas is eliminated by pre-transfer eraser 221. This elimination of charge by pre-transfer eraser 221 is performed in order to make the transfer electric field uniform by reducing the charge in the non-developed areas, such that transfer defects, such as blank spots in the transferred image, may be prevented.

Figure 2:
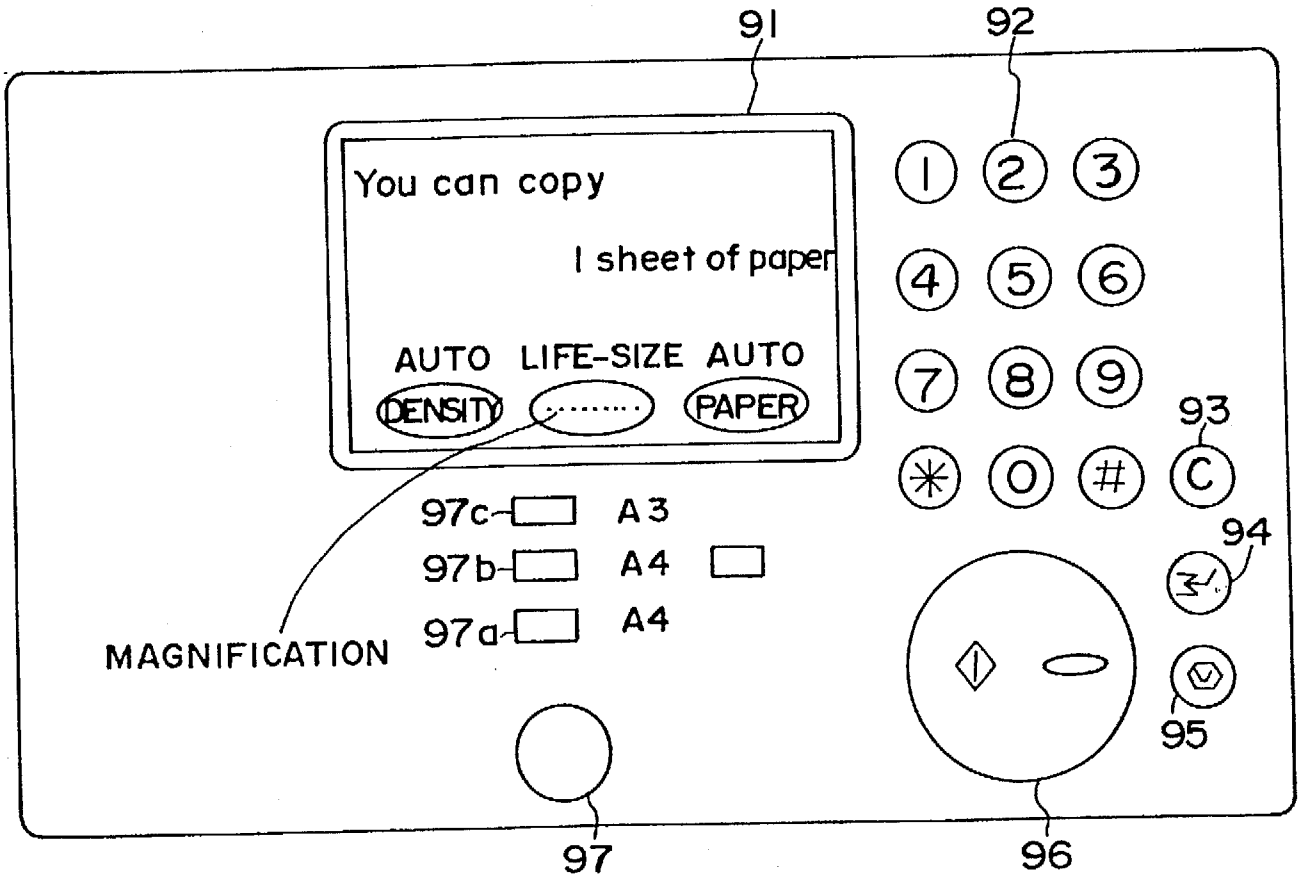
FIG. 2 is a drawing of an operation panel pertaining to the present invention.

FIG. 2 shows the operation panel.

91 is a liquid crystal display. 92 is a 10-key keypad. 93 is a clear key. 94 is an interrupt key. 95 is a stop key. 96 is a print start key. 97 is a paper size setting key. 97*a* through 97*c* are LEDs that indicate the paper size that is set.

Figure 3:
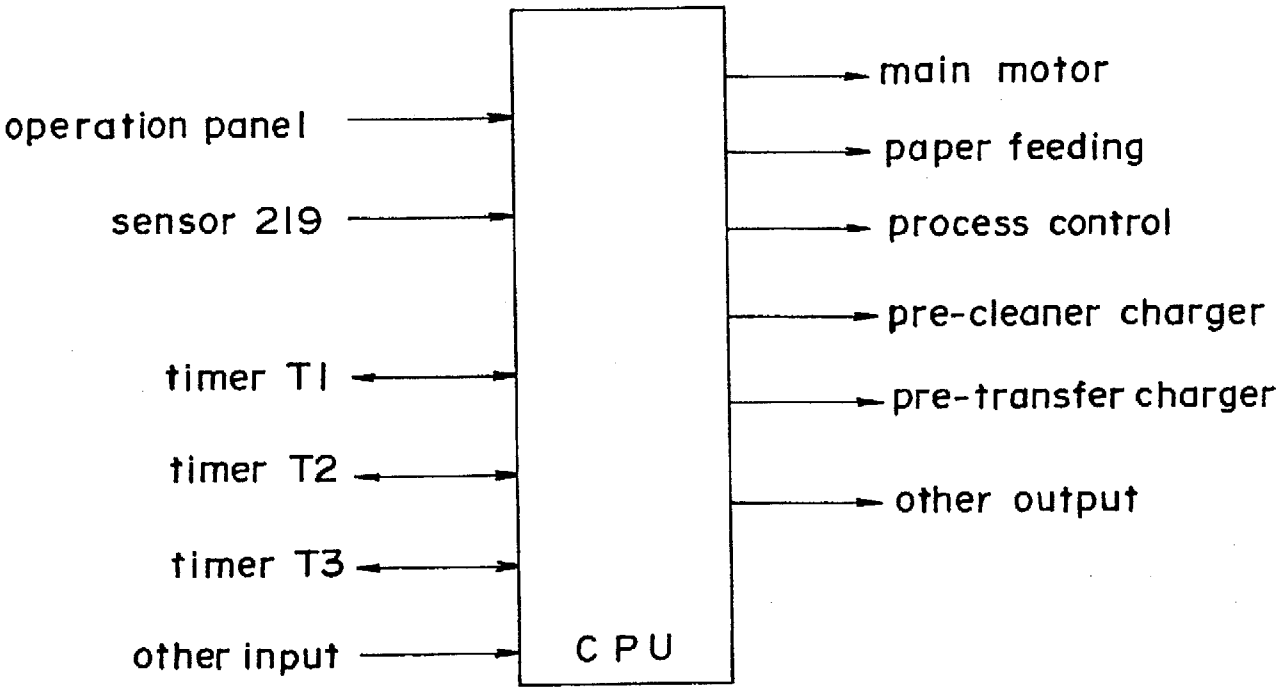
FIG. 3 is a control block diagram pertaining to the present invention.

FIG. 3 is a control block diagram.

Signals from the operation panel, sensor 219 and other elements are input to the CPU. To the output terminals of the CPU are connected the main motor, paper feeding/holding unit, process control unit, pre-cleaner charger, pre-transfer eraser, etc.

Figure 4:
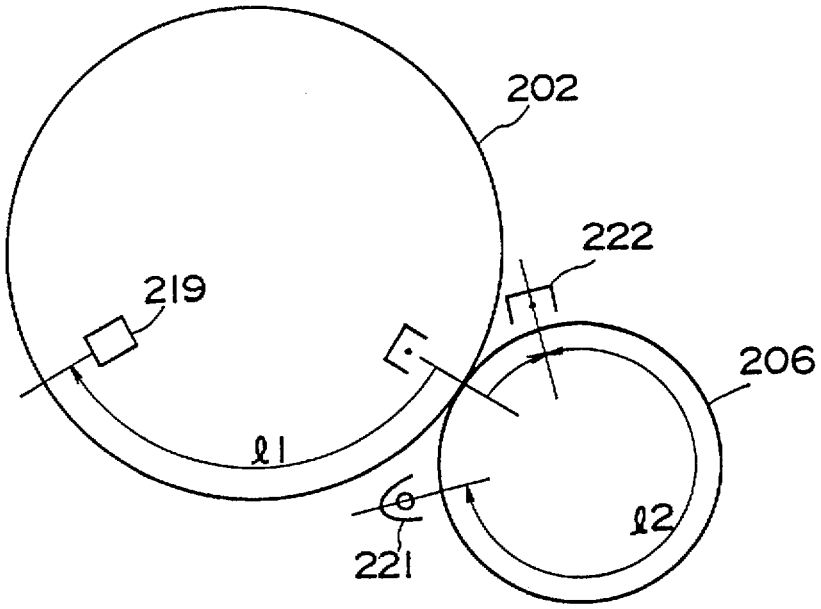
FIG. 4 is a drawing to explain the arrangement of the elements in the present invention.

FIG. 4 is a drawing to explain the arrangement of various elements.

In FIG. 4, the distance between sensor 219 and pre-cleaner charger 222 via transfer charger 205 is set to be L1. The distance between pre-cleaner charger 222 and pre-transfer eraser 221 is set to be L2. If the selected paper size is S, the system speed is V, the margin for turning ON the pre-cleaner charger is α, the margin for turning ON the pre-transfer charger is β, and the circumference of photosensitive drum 206 is L3, time period T1 from the time the first edge of the paper is detected by sensor 219 until the pre-cleaner charger is turned ON, time period T2 from the time the first edge of the paper is detected by sensor 219 until the pre-transfer charger is turned OFF, and time period T3 needed for photosensitive drum 206 to rotate once are respectively obtained using the following calculations.

$$T1=(L1+S-\alpha)/V$$

$$T2=(L1+L2+S-\beta)/V$$

$$T3=L3/V$$

In this embodiment, a case is shown in which the ratio of the circumference of the transfer drum to the circumference of the photosensitive drum is 2:1, and in which two sheets of paper can be held onto the transfer drum if the paper size is A4 horizontal. However, the present invention may be applied in a construction in which the circumference of the transfer drum is three times as large as that of the photosensitive drum, or in a construction in which three or more sheets of paper may be held onto the transfer drum.

Figure 5:
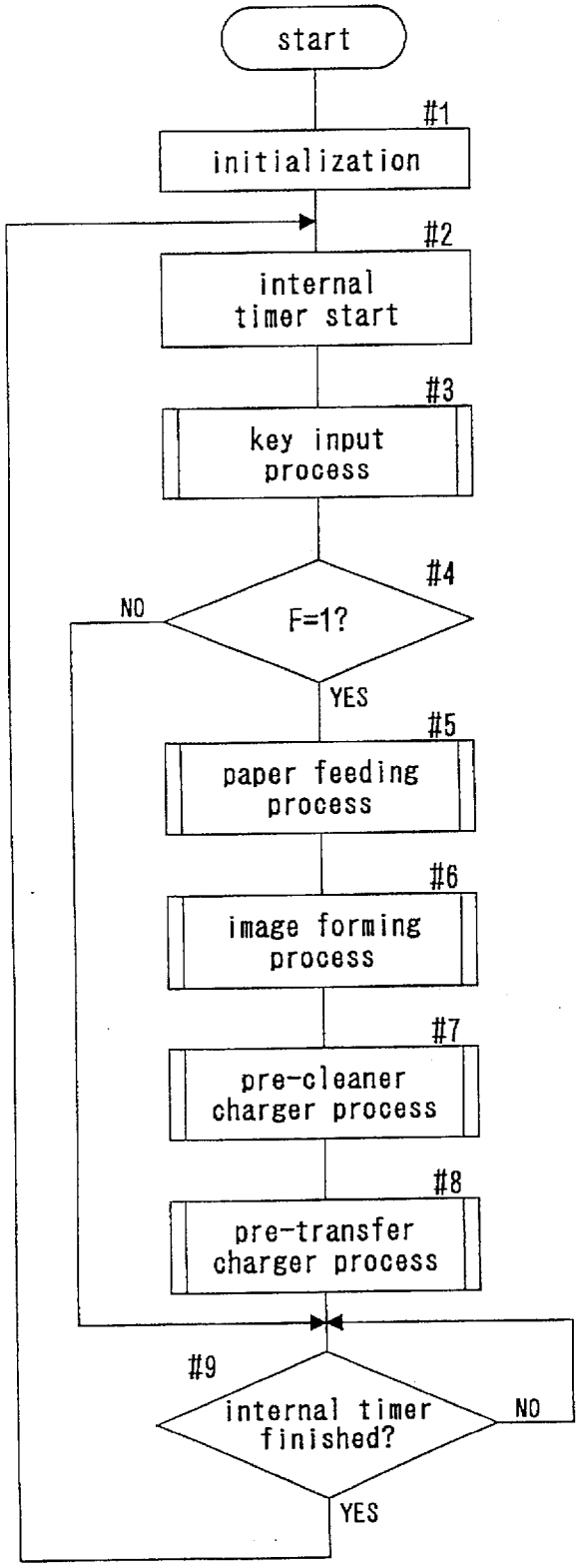
FIG. 5 shows the main routine of the process pertaining to the present invention.

FIG. 5 shows the main routine showing the control of the present invention.

In FIG. 5, the process begins with turning the power ON. Various initialization routines are carried out in step #1. The internal timer is started in step #2. The processing of inputs from various keys on the operation panel is carried out in step #3. It is determined in step #4 whether or not copy operation flag F is '1'. This copy operation flag F is set to '1' while the copy machine is in operation, and it becomes '0' when the copying session is completed. Where copy operation flag F is '0' in step #4, step #2 is returned to after the internal timer comes to an end in step #9. Where copy operation flag F is '1' in step #4, or in other words, where the copy machine is in operation, paper is fed and held onto the transfer drum in step #5, the image formation sequence takes place in step #6, the pre-cleaner charger sequence takes place in step #7, and the pre-transfer eraser sequence takes place in step #8.

Figure 6:
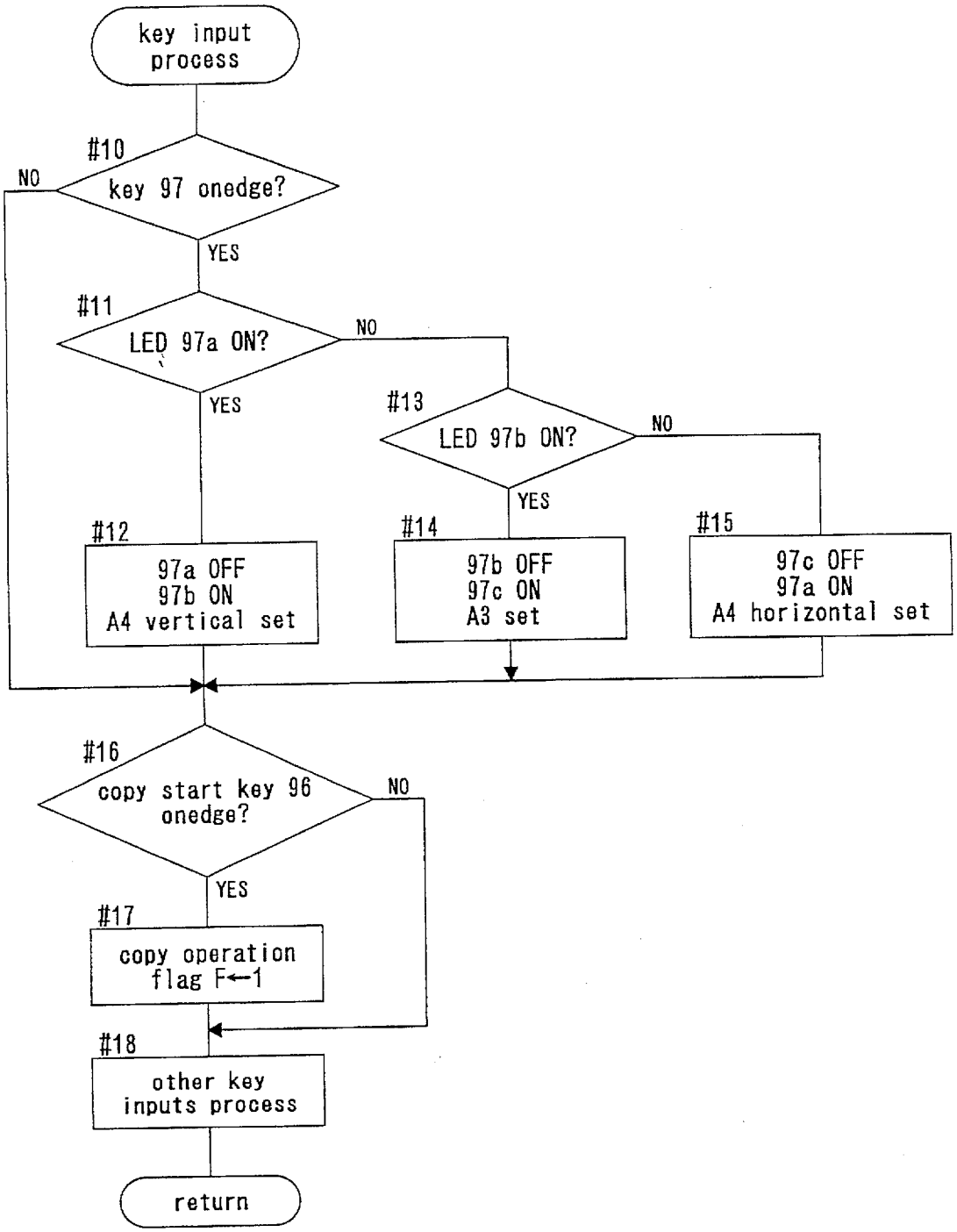
FIG. 6 is a subroutine showing the key input sequence in the present invention.

FIG. 6 shows the key input sequence subroutine in step #3 described above.

It is determined in step #10 whether or not an ON edge of key 97 exists. Where an ON edge does not exist, the process advances to step #16. Where an ON edge exists, the process advances to step #11, in which it is determined whether or not LED 97*a* is illuminated. Where LED 97*a* is illuminated, the process advances to step #12, in which LED 97*a* is turned OFF, LED 97*b* is illuminated and the paper size is set to be A4 vertical. Where LED 97*a* is not illuminated, the process advances to step #13, in which it is determined whether or not LED 97*b* is illuminated. Where LED 97*b* is illuminated, the process advances to step #14. In step #14, LED 97*b* is turned OFF, LED 97*c* is illuminated, and the paper size is set to be A3. Where LED 97*b* is not illuminated, the process advances to step #15, in which LED 97*c* is turned OFF, LED 97*a* is illuminated, and the paper size is set to be A4 horizontal. In step #16, it is determined whether or not an ON edge of print start key 96 exists. Where it exists, the process advances to step #17, in which copy operation flag F is set to be '1'. The process then advances to step #18. Where an ON edge does not exist, the process advances to step #18. In step #18, processing of other key inputs is performed and the main routine is returned to.

Figure 7:
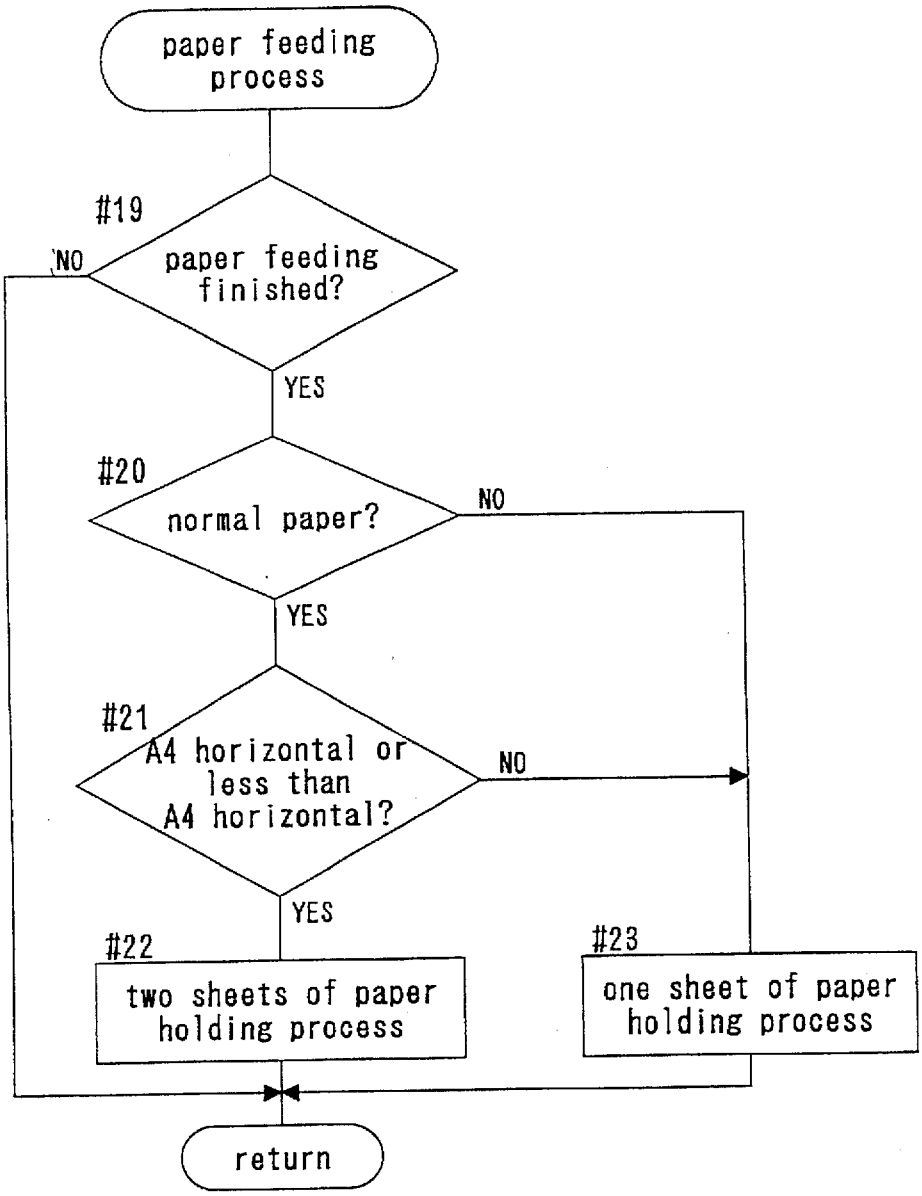
FIG. 7 is a subroutine showing the paper feed sequence in the present invention.

FIG. 7 shows the paper feed sequence subroutine in step #5 of FIG. 5.

It is determined in step #19 whether or not paper feed is completed. Where it is not completed, the main routine is returned to without any further processing. Where it is completed, the process advances to step #20, in which it is determined whether or not the paper is normal paper. Where it is normal paper, the process advances to step #21, in which it is determined whether or not the paper size is A4 horizontal or smaller. Where it is A4 horizontal or smaller, the process advances to step #22, in which a sequence to hold two sheets of paper onto transfer drum 202 is carried out, following which the main routine is returned to. Where it is determined in step #20 that the paper is not normal paper, or where it is determined in step #21 that the paper size is not A4 horizontal or smaller, the process advances to step #23, in which a sequence to hold one sheet of paper onto transfer drum 202 is carried out, following which the main routine is returned to.

Figure 8:
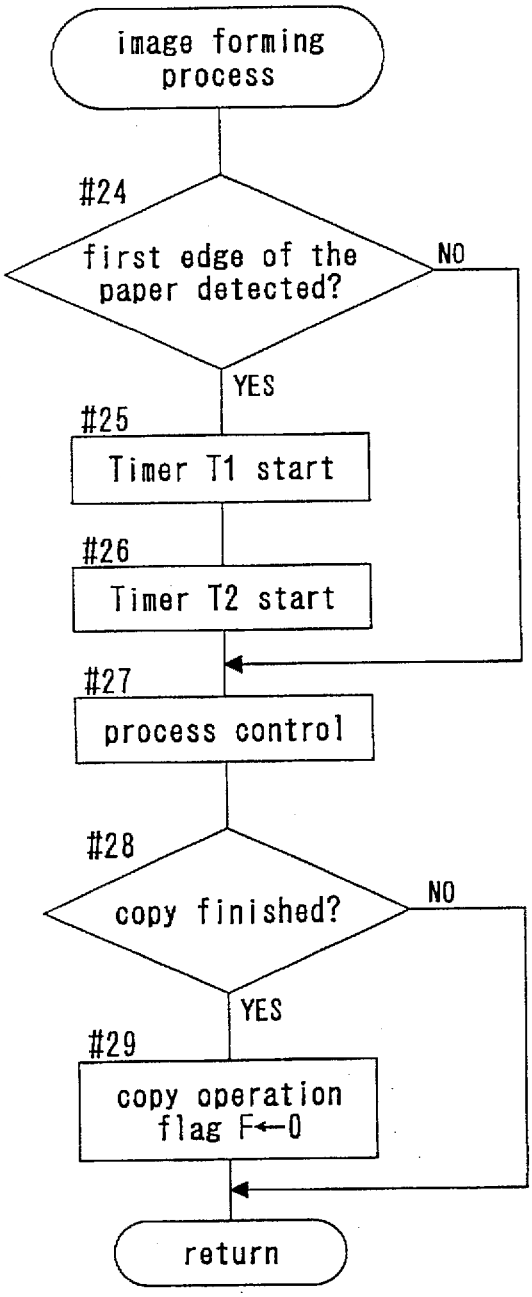
FIG. 8 is a subroutine showing the image formation sequence in the present invention.

FIG. 8 shows the image formation sequence subroutine in step #6 of FIG. 5.

It is determined in step #24 whether or not the first edge of the paper is detected. Where it is not detected, the process advances to step #27. Where the first edge of the paper is detected, the process advances to step #25, in which timer T1 is started. Timer T2 is then started in step #26. Timers T1 and T2 are timers to determine whether time periods T1 and T2 described above have elapsed, respectively. In step #27, various process controls take place. It is then determined in step #28 whether or not the copying operation is completed. Where it is not completed, the main routine is returned to without any further processing. Where the copying is completed, the process advances to step #29, in which copy operation flag F is set to be '0', and the main routine is returned to.

Figure 9:
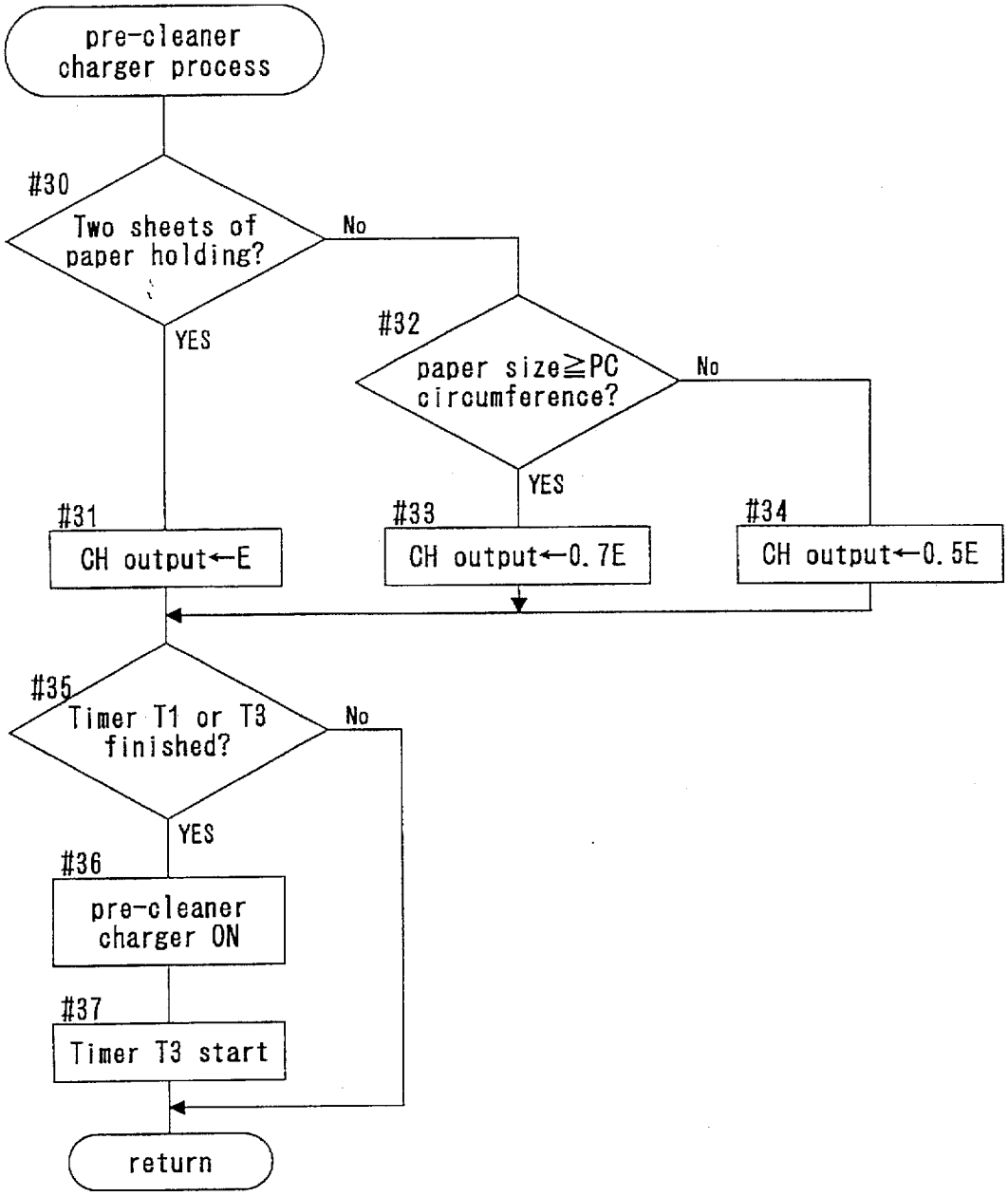
FIG. 9 is a subroutine showing the pre-cleaner charger sequence in the present invention.

FIG. 9 shows the pre-cleaner charger sequence subroutine in step #7 of FIG. 5.

It is determined in step #30 whether or not two sheets of paper are being held onto transfer drum 202. Where two sheets of paper are being held onto transfer drum 202, the process advances to step #31. Since a last edge memory effect takes place at the same area because of the electrical discharge that occurs as the last edge of the paper separates each time photosensitive drum 206 rotates, the output of pre-cleaner charger 222 is set to E in order to eliminate this last edge memory effect using one output of pre-cleaner charger 222. Where it is determined in step #30 that two sheets of paper are not being held onto transfer drum 202, the process advances to step #32, in which it is determined whether or not the paper size is larger than the circumference of photosensitive drum 206. Where the paper size is larger than the circumference of photosensitive drum 206, the process advances to step #33, in which the output of pre-cleaner charger 222 is set to 0.7 E. The output may be thus reduced because the location on photosensitive drum 206 at which the last edge memory effect occurs with regard to the first color image comes into the image area for the second color when photosensitive drum 206 has rotated once, and therefore a last edge memory effect due to the electrical discharge at the separation of paper does not take place when photosensitive drum 206 rotates for the second color, which means that the last edge memory effect occurring at one area can be eliminated using two outputs of pre-cleaner charger 222, i.e., when the first color image passes pre-cleaner charger 222 and when the second color image passes pre-cleaner charger 222. Where the paper size is not larger than the circumference of photosensitive drum 206, the process advances to step #34, in which the output of pre-cleaner charger 222 is set to be 0.5 E. The output may be thus further reduced because where the paper size is shorter than the circumference of photosensitive drum 206, the location at which the last edge memory effect occurs is outside the image area for the second color, and therefore it is not necessary to consider its effect on the second color image, and the last edge memory effect may be eliminated by two outputs of pre-cleaner charger 222. After the output of pre-cleaner charger 222 is set, it is determined in step #35 whether or not timer T1 or T3 has come to an end. Timer T3 is a timer to determine whether time period T3 described above has elapsed. Where it is determined in step #35 that either of the timers has come to an end, the process advances to step #36, in which pre-cleaner charger 222 is turned ON. The process then advances to step #37, in which timer T3 is started, and the main routine is returned to. Where it is determined that neither of the timers has come to an end, the main routine is returned to without any further processing. The output of pre-cleaner charger 222 can be obtained at an appropriate level each time photosensitive drum 206 rotates based on steps #35 and #36.

Figure 10:
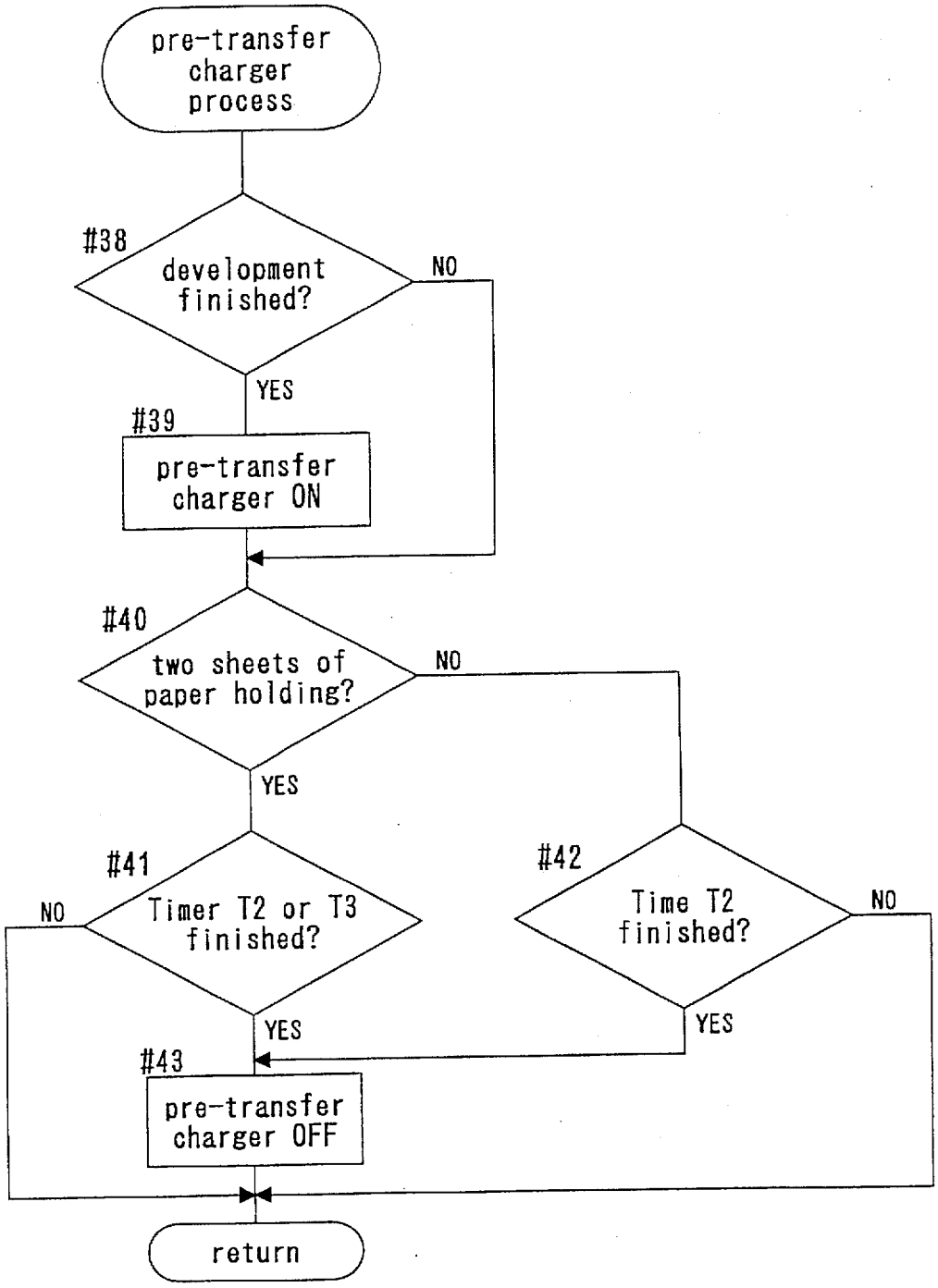
FIG. 10 is a subroutine showing the pre-transfer charger sequence in the present invention.
Figure 11A:
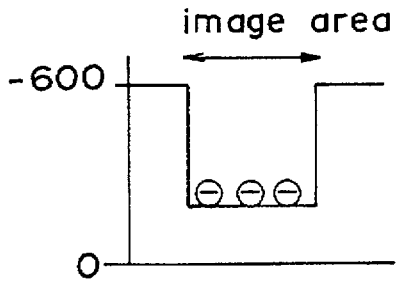
FIGS. 11*a* through 11*e* are drawings showing the changes in potential of the surface of the photosensitive drum.
Figure 11B:
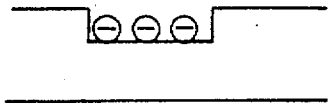
Figure 11C:
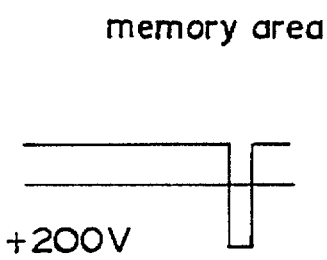
Figure 11D:
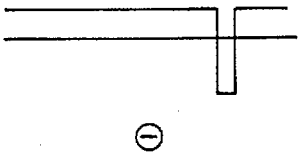
Figure 11E:
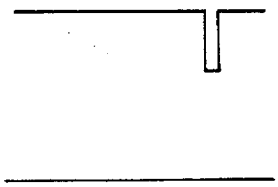

FIG. 10 shows the pre-transfer eraser sequence subroutine in step #8 of FIG. 5.

It is determined in step #38 whether or not the development sequence is completed. Where the development sequence is determined to be completed, the process advances to step #39, in which pre-transfer eraser 221 is turned ON, and the process advances to step #40. Where the development sequence is determined to be not completed, the process advances to step #40. It is determined in step #40 whether or not two sheets of paper are being held onto transfer drum 202. Where two sheets of paper are being held, the process advances to step #41. Where it is determined that two sheets of paper are not being held onto transfer drum 202, the process advances to step #42, in which it is determined whether or not timer T2 has come to an end. In step #41, it is determined whether or not timer T2 or T3 has come to an end. Where it is determined that neither timer has come to an end, the main routine is returned to without any further processing. Where it is determined that either timer has come to an end, the process advances to step #43. Where it is determined in step #42 that timer T2 has not come to an end, the main routine is returned to without any further processing. Where it is determined that timer T2 has come to an end, the process advances to step #43. In step #43, pre-transfer eraser 221 is turned OFF and then the main routine is returned to. Through this sequence, the potential of photosensitive drum 206 may be maintained high at the area where the last edge of the paper held onto transfer drum 202 comes into contact with it and separates from it, regardless of the number of sheets held on transfer drum 202. Consequently, the adverse effects of the last edge memory effect may be controlled.

FIGS. 12*a* through 12*g* are drawings showing the effect of the present invention.

Figure 12A:
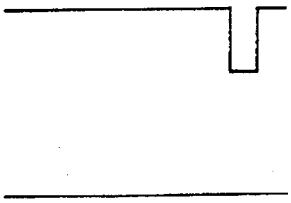
FIGS. 12*a* through 12*g* are drawings showing the changes in potential of the surface of the photosensitive drum.
Figure 12B:
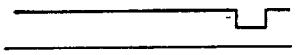
Figure 12C:
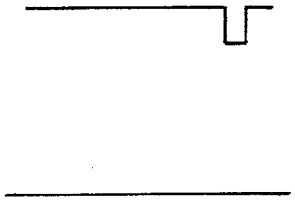
Figure 12D:
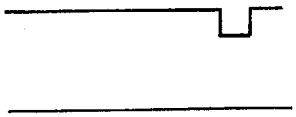
Figure 12E:
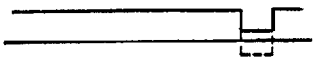
Figure 12F:
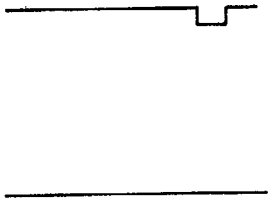
Figure 12G:
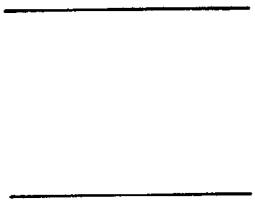

Here a case is shown in which only one sheet of paper, which is longer than the circumference of the photosensitive drum, is being held onto the transfer drum. In FIG. 12*a*, when the pre-cleaner charger is turned ON with an output of 0.7 E with regard to the photosensitive drum surface on which there is a memory area, the surface becomes uniformly charged at −600V, except for the memory area, which does not become charged up to the same level but reach only −400V. In FIG. 12*b*, the entire surface is irradiated by the eraser, but the potential of the memory area remains lower than that of other areas. In FIG. 12*c*, the surface is uniformly charged at −600V, but the memory area still remains lower at −550V. When the surface is exposed to the laser beam in order to form an image having a uniform density, other areas come to have a charge of −300V and the memory area comes to have a charge of −280V. This difference gives rise to an unevenness in image that cannot be distinguished. The image is developed in FIG. 12*e* and transfer is carried out with the pre-transfer charger turned ON. Because the memory area that occurred during the first transfer session is not located at the last edge of the paper in the current transfer session, the potential of the memory area does not tend toward the positive side to a significant degree, but is still lower than that of other areas. When the photosensitive drum is charged by means of the pre-cleaner charger in FIG. 12*f*, the surface becomes uniformly charged at −600V except for the memory area which becomes charged at −550V. When the surface is charged by means of the eraser in this condition, the potential of the entire surface becomes −600V as shown in FIG. 12*g*, whereby the memory area is eliminated.

Figure 13A:
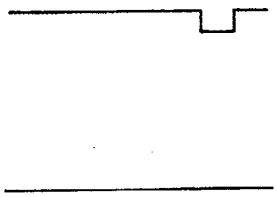
FIGS. 13*a* through 13*g* are drawings showing the changes in potential of the surface of the photosensitive drum.
Figure 13B:
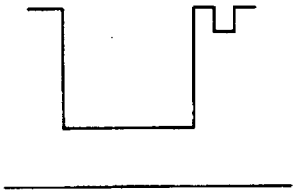
Figure 13C:
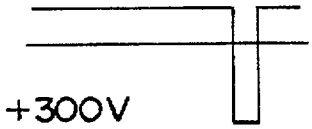
Figure 13D:
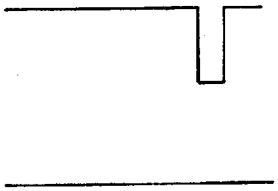
Figure 13E:
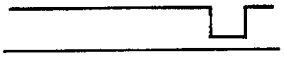
Figure 13F:
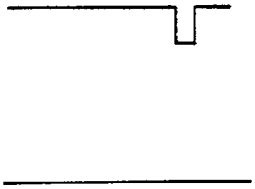
Figure 13G:
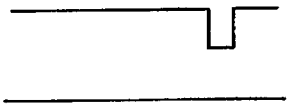

FIGS. 13*a* through 13*g* are drawings that show the inconvenience that occurs when charging of the memory area using the pre-cleaner charger is carried out only when the last edge of the paper has passed the transfer position. Even if the memory area is eliminated to the point where no adverse effect is caused to the image, another memory area is created at the same location when the last edge of the next paper passes the transfer position (FIG. 13*c*). Consequently, together with the remaining memory area from the previous session which was not completely corrected, the memory area increases each time the image formation cycle is repeated. Therefore, where the last edge of the paper passes the transfer position each time the photosensitive drum rotates, as in the case where two sheets of paper are held onto the transfer drum, a large output (E in this embodiment) is required in order to eliminate the memory area with one output of the pre-cleaner charger.

Figure 14A:
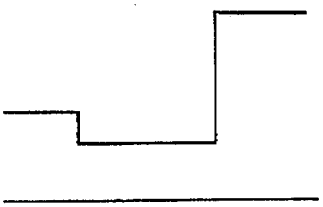
FIGS. 14*a* through 14*d* are drawings showing the changes in potential of the surface of the photosensitive drum.
Figure 14B:
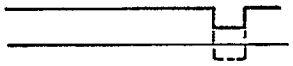
Figure 14C:
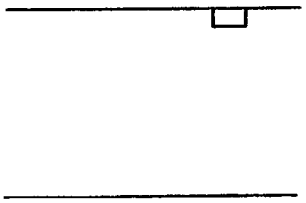
Figure 14D:
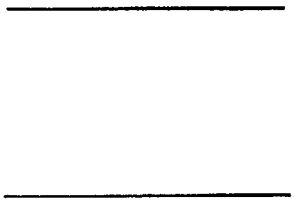

On the other hand, FIGS. 14*a* through 14*d* are drawings showing the effect when the pre-transfer eraser is turned OFF with regard to the area corresponding to the last edge of the paper. As shown in FIG. 14*a*, if the pre-transfer eraser is turned OFF with regard to the area corresponding to the last edge of the paper, the potential of the area for which the pre-transfer eraser was turned OFF does not decrease. Therefore, even where an electrical discharge has occurred after transfer as the paper separates from the photosensitive drum, the polarity of the photosensitive drum does not tend toward the positive (FIG. 14*b*) because the original potential is high, and the memory area may be eliminated using the pre-cleaner charger, eraser and charger with good results (FIGS. 14*c* and 14*d*).

Using the image forming apparatus of the present invention, the output of the pre-cleaner charger is changed among several levels in accordance with the set image formation mode, such as the paper size and the number of sheets to be held onto the transfer drum, and therefore the surface of the photosensitive drum is not damaged by an unnecessarily large charger output, but the memory area can be reduced to a level where no adverse effect is caused to the image.

In addition, using the image forming apparatus of the present invention, since the pre-transfer eraser is turned OFF with regard to the area corresponding to the last edge area of the paper, the potential of this area may be maintained at a high level on the negative side, and even if an electrical discharge at the separation of paper occurs, the adverse effects caused to the image due to the memory effect may be reduced.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus in which a toner image formed on an image carrier is transferred onto paper held onto a transfer drum following which the paper is separated from the transfer drum, comprising:

a charger which charges a prescribed area of the image carrier before the image carrier is uniformly charged;

a mode setting means which sets the image formation mode; and a control means which controls the output of said charger in accordance with the image formation mode set by said mode setting means.

2. An image forming apparatus as defined in claim 1, wherein the prescribed area charged by said charger is a position of a surface of the image carrier equivalent to a last end of the paper.

3. An image forming apparatus as defined in claim 1, wherein said control means changes the output of said charger among several level options.

4. An image forming apparatus as defined in claim 1, wherein said mode setting means sets the paper size.

5. An image forming apparatus as defined in claim 1, wherein said mode setting means sets the number of sheets to be held onto the transfer drum.

6. An image forming apparatus as defined in claim 1, wherein the transfer drum has a paper carrier sheet consisting of a polyvinyliden fluoride resin film.

7. An image forming apparatus in which a toner image formed on an image carrier is transferred onto paper held onto a transfer drum, comprising:

a pre-transfer eraser which erases to eliminate a charge of a non-developed areas of the image carrier prior to the transfer of the toner image onto the paper held onto the transfer drum, after forming the toner image onto the image carrier; and control means which controls an output of said pre-transfer eraser for a prescribed area of the image carrier such that it is different from the output of said pre-transfer eraser for areas other than the prescribed area.

8. An image forming apparatus as defined in claim 7, wherein the prescribed area charged by said charger is a position of a surface of the image carrier equivalent to a last end of the paper.

* * * * *